US006029732A

United States Patent [19]

Malott

[11] Patent Number: 6,029,732

[45] Date of Patent: Feb. 29, 2000

[54] AWNING WITH RAIL MOUNTED RAFTER

[75] Inventor: Dale G. Malott, Middlebury, Ind.

[73] Assignee: White Consolidated Industries, Inc., Cleveland, Ohio

[21] Appl. No.: 09/111,504

[22] Filed: Jul. 7, 1998

[51] Int. Cl.[7] ..... E04F 10/06

[52] U.S. Cl. ..... 160/67; 135/88.12

[58] Field of Search ..... 160/67, 66, 22, 160/44, 68, 71, 80; 135/88.11, 88.12; 248/273

[56] References Cited

U.S. PATENT DOCUMENTS

| | | | |
|---|---|---|---|
| 1,790,793 | 2/1931 | Cara | 160/44 X |
| 1,813,525 | 7/1931 | Astrup . | |
| 1,976,708 | 10/1934 | Anderson . | |
| 2,189,525 | 2/1940 | Treffeisen . | |
| 2,506,285 | 5/1950 | Wagner | 160/44 X |
| 3,478,806 | 11/1969 | Darula . | |
| 3,720,438 | 3/1973 | Johnson et al. . | |
| 3,851,848 | 12/1974 | Wiele | 248/273 |
| 3,866,874 | 2/1975 | Upton, Jr. . | |
| 4,077,419 | 3/1978 | Lux . | |
| 4,117,876 | 10/1978 | Bennett . | |
| 4,164,972 | 8/1979 | Bennett . | |
| 4,180,117 | 12/1979 | Greer . | |
| 4,658,877 | 4/1987 | Quinn . | |
| 4,924,895 | 5/1990 | Bailie | 160/67 X |
| 5,016,699 | 5/1991 | Akers et al. | 160/22 |
| 5,207,255 | 5/1993 | Shannon . | |
| 5,560,411 | 10/1996 | Becker . | |
| 5,622,214 | 4/1997 | Baka et al. . | |
| 5,732,756 | 3/1998 | Malott . | |

*Primary Examiner*—David M. Purol

*Attorney, Agent, or Firm*—Pearne, Gordon, McCoy & Granger LLP

[57] ABSTRACT

A retractable awning assembly for mounting to a wall having a relatively thin outer skin such as the side wall of a recreational vehicle includes a rail attached to the wall and having a longitudinally extending channel which is C-shaped in cross-section, a roller, a flexible canopy having an inner edge connected to the channel and an outer edge secured to the roller, a pair of upper mounting brackets attached at opposite ends of the rail, and a pair of arm assemblies supporting opposite ends of the roller and operable to move said roller between a retracted position adjacent the wall and an extended position spaced from the wall. Each of the arm assemblies has a support arm with a lower end secured to the wall and a rafter arm with an inner end attached to the upper mounting bracket. Each of the upper mounting brackets cradle the rail over the channel for positively locating the brackets relative to the rail and for transferring operational forces of the awning assembly, which are transmitted through the rafter arms, to the rail to prevent damage to the outer skin. A portion of the forces are transferred to the rail because the upper mounting brackets do not contact the wall and/or closely receive a gutter extending from the channel.

24 Claims, 4 Drawing Sheets

FIG. 1
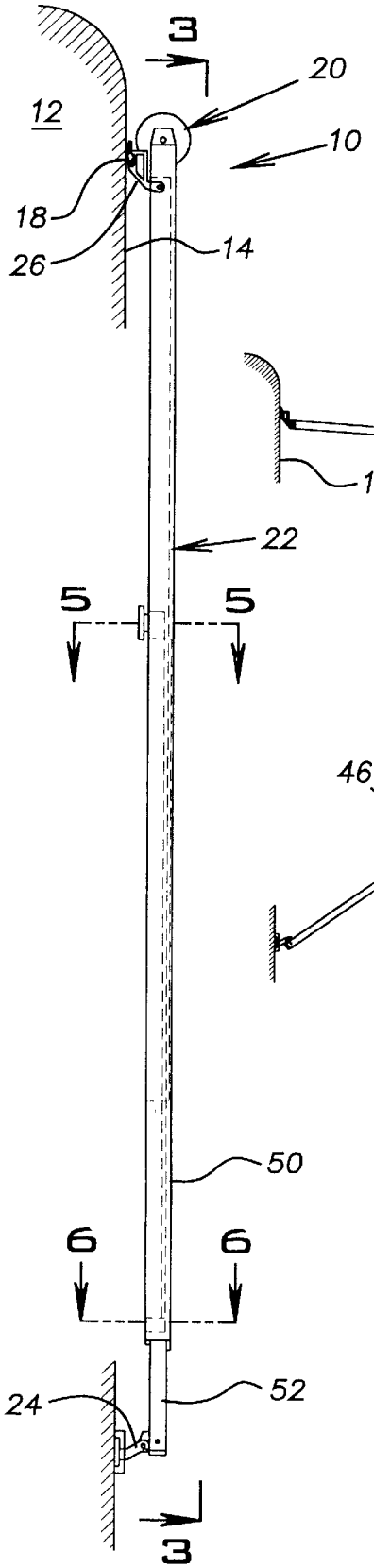
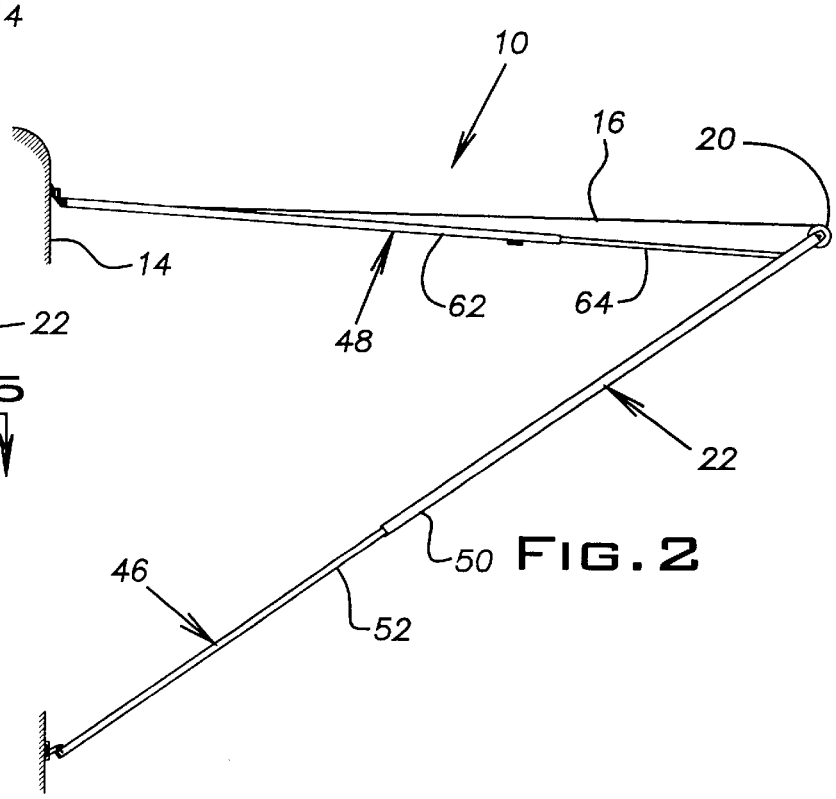
FIG. 2

AWNING WITH RAIL MOUNTED RAFTER

BACKGROUND OF THE INVENTION

The present invention generally relates to retractable awnings and, more specifically, to retractable awnings having tension rafters.

There are a number of known retractable awning assemblies that support an awning or canopy to create a sheltered area. An inner end of the canopy is typically secured to a wall by an awning rail or header rail. An outer end of the canopy is typically secured to the roller tube. The roller tube is supported at its ends by support arms for movement between a retracted position, wherein the roller tube is disposed adjacent the wall, and an extended position, wherein the roller tube is spaced from the wall. When the roller tube is in the retracted position, the canopy is rolled-up on the roller tube. When the roller tube is in the extended position, the canopy is unrolled from the roller tube and extends between the wall and the roller tube.

Rafter arms or tension rafters are typically provided to hold the support arms in the extended positions and tension the canopy. The rafter arms extend from the wall to the support arms and/or roller tube. The rafter arms are typically secured directly to the wall by mounting brackets which are not positively positioned with respect to the awning rail. Therefore, the position of the rafter arms relative to the awning rail can vary, sometimes with problematic results.

These retractable awning assemblies are often designed for use with mobile structures such as, for example recreational vehicles, travel trailers mobile homes, and the like. The walls of these structures often have a relatively thin outer skin which covers an inner structure. This outer skin is easily damaged by operational forces of the awning assembly which are transmitted through the rafter arms because the mounting brackets are directly contacting and secured to the outer skin.

Accordingly, there is a need in the art for an improved awning assembly which positively positions the rafters arms relative to the awning rail and/or has rafter arms which do not damage walls having relatively thin outer skins.

BRIEF SUMMARY OF THE INVENTION

The present invention provides a retractable awning assembly for attachment to a wall which overcomes at least some of the above-noted problems of the related art. According to the present invention, the awning assembly includes an awning rail which has a longitudinally extending channel, a roller, a flexible canopy having an inner edge for connection to the channel and an outer edge secured to the roller, a pair of upper mounting brackets for attachment at opposite ends of the rail, and a pair of arm assemblies supporting opposite ends of the roller and operable to move the roller between a retracted position adjacent the wall and an extended position spaced from the wall. Each of the upper mounting brackets is sized and shaped to cradle the rail over the channel. Each of the arm assemblies has a support arm and a rafter arm. The support arm has an upper end operably connected to the roller and a lower end securable to the wall. The rafter arm has an outer end operably connected to the support arm and an inner end for attachment to the upper mounting bracket. Because the upper mounting brackets cradle a portion of the awning rail, they are positively located relative to the rail to prevent misalignment and/or at least a portion of the operational forces of the awning assembly, which are transmitted through the rafter arms, are transferred through the rail to prevent damage to the wall.

According to another aspect of the present invention, a retractable awning assembly includes a rail having a longitudinally extending channel which is generally C-shaped in cross-section and a longitudinally extending gutter outwardly extending from the channel, a roller, a flexible canopy having an inner edge for connection to the channel and an outer edge secured to the roller, a pair of upper mounting brackets for attachment at opposite ends of the rail, and a pair of arm assemblies supporting opposite ends of the roller and operable to move the roller between a retracted position adjacent the wall and an extended position spaced from the wall. Each of the upper mounting brackets is sized and shaped to cradle the rail over the channel and has a longitudinally extending slot for closely receiving a portion of the gutter therein. Each of the arm assemblies has a support arm and a rafter arm. The support arm has an upper end operably connected to the roller and a lower end securable to the wall. The rafter arm has an outer end operably connected to the support arm and an inner end for attachment to the upper mounting bracket. Because the upper mounting brackets receive a gutter of the rail, they are positively located relative to the rail to prevent misalignment and/or at least a portion of the operational forces of the awning assembly which are transmitted through the rafter arms are transferred through the rail to prevent damage to the wall.

BRIEF DESCRIPTION OF THE SEVERAL VIEWS OF THE DRAWING

These and further features of the present invention will be apparent with reference to the following description and drawings, wherein:

FIG. 1 is a side elevational view, partially in cross-section, of an awning assembly according to the present invention in a retracted position;

FIG. 2 is a side elevational view, in partial cross-section, of the awning of FIG. 1 in an extended position;

DETAILED DESCRIPTION OF PREFERRED EMBODIMENTS

Figures 3, 5, 6:
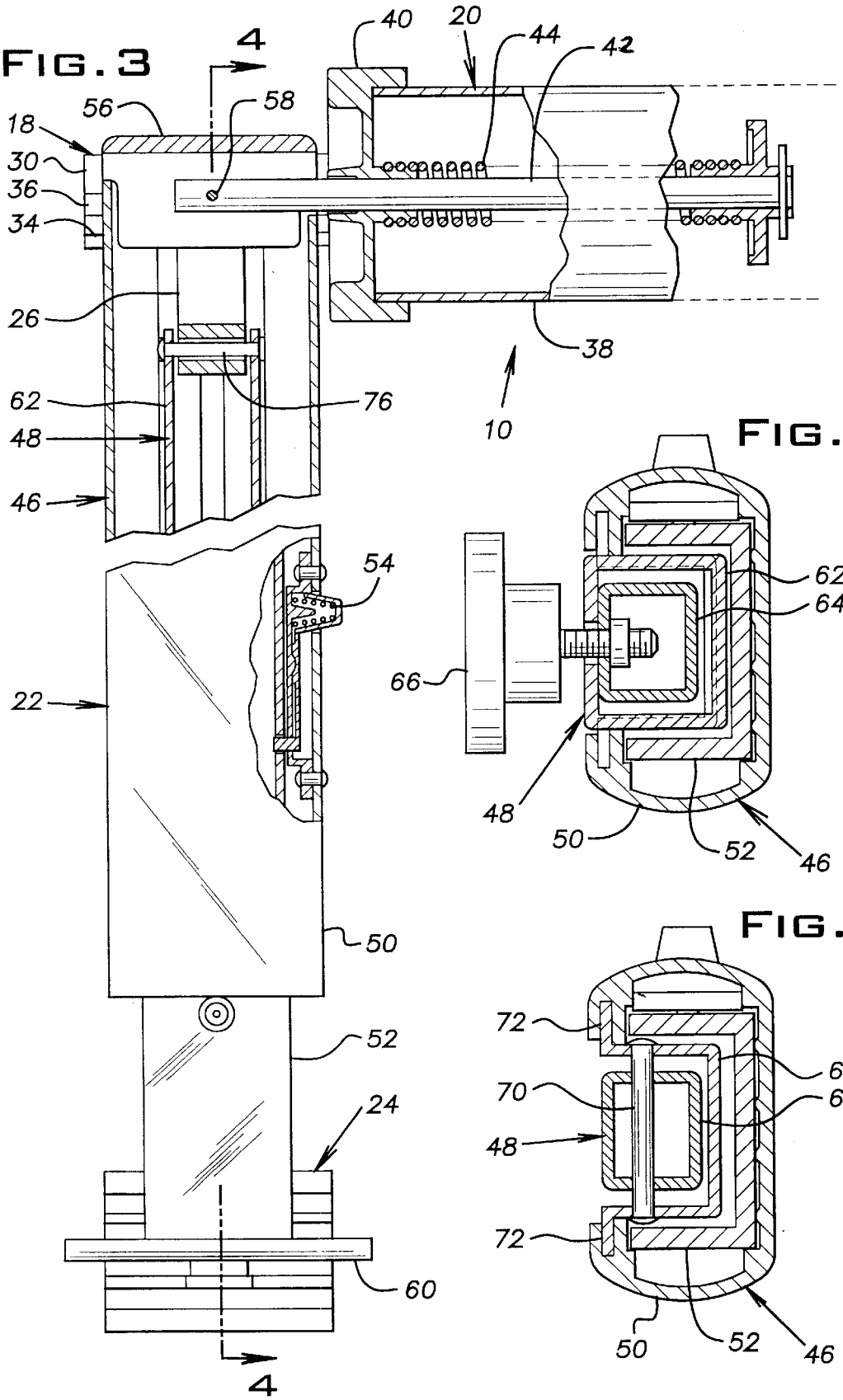
FIG. 3 is a fragmented cross-sectional view taken along line 3—3 of FIG. 1.
FIG. 5 is a cross-sectional view taken along line 5—5 of FIG. 1.
FIG. 6 is a cross-sectional view taken along line 6—6 of FIG. 1.
Figure 4:
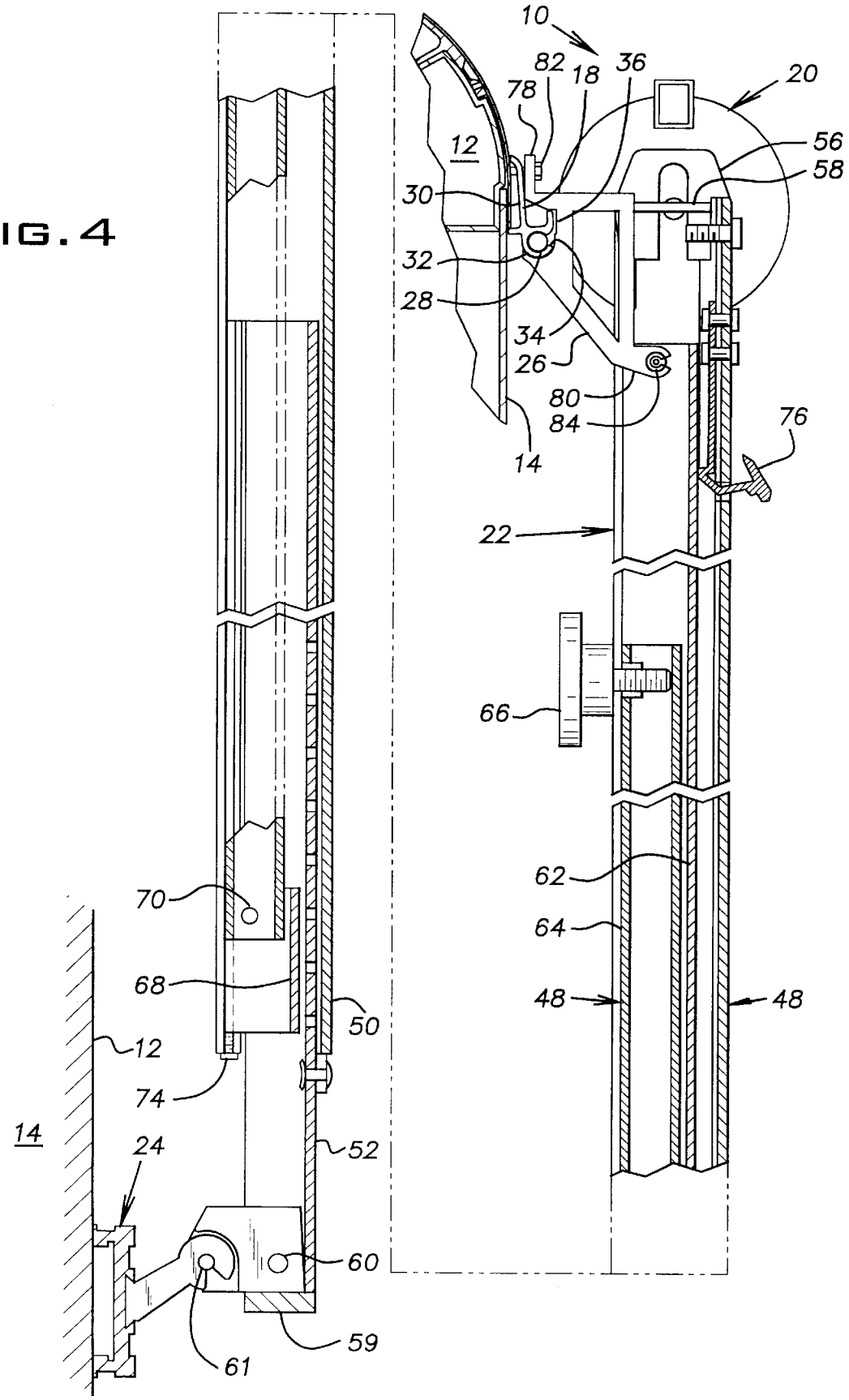
FIG. 4 is a cross-sectional view taken along line 4—4 of FIG. 3.
Figure 7:
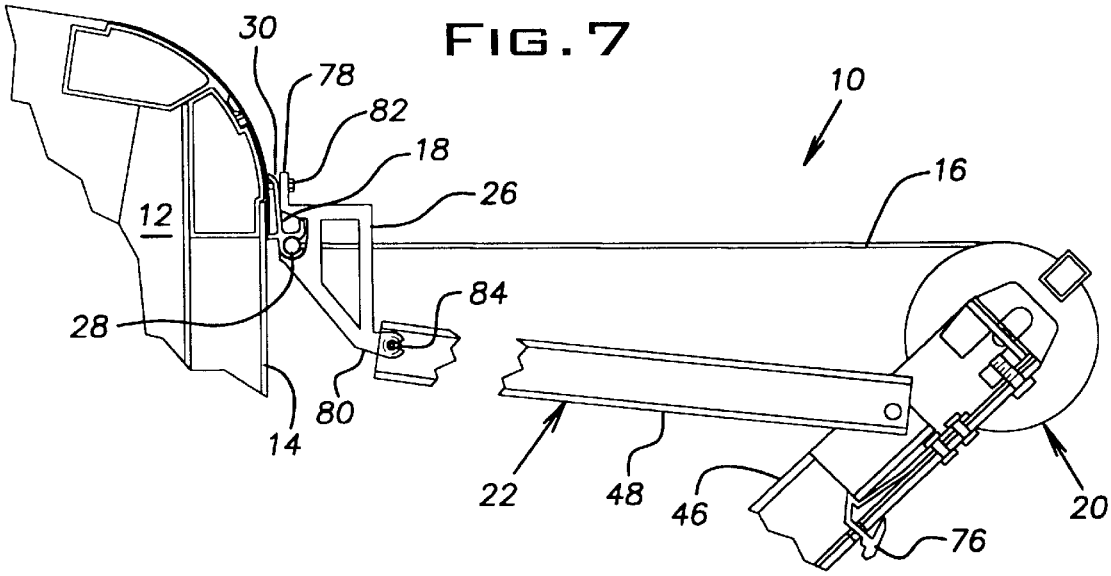
FIG. 7 is a fragmented side elevational view of the awning assembly of FIG. 2 showing the rafter arm mounting brackets.

FIGS. 1 to 7 illustrate a retractable awning assembly 10 which is mounted according to the present invention to a recreational vehicle 12 at a side wall 14. The term "recreational vehicle", as used in the specification and claims, includes campers, travel trailers, mobile homes, vans, and the like. The illustrated awning assembly 10 is mounted to a vertically-extending portion of the side wall 14. The side wall 14 typically includes an inner support structure and a relatively thin outer skin which covers the support structure (as best shown in FIGS. 4 and 7).

As best shown in FIGS. 1 and 2, the awning assembly 10 is operable between a retracted or stored position (shown in FIG. 1) and an extended or sheltering position (shown in FIG. 2). In the retracted position, the awning assembly 10 is in a compact configuration close to the side wall 14 of the recreational vehicle 12 so that the recreational vehicle 12 can travel to desired destinations. After a destination is reached, the awning assembly 10 is deployed from the retracted position to the extended position if a covered area adjacent the recreational vehicle 12 is desired to protect against sun, rain, and the like.

The awning assembly 10 includes an awning or canopy 16 for selectively covering an area adjacent to the recreational vehicle 12, an awning or header rail 18 securing the canopy 16 to the recreational vehicle side wall 14, a roller assembly 20 for furling and unfurling the canopy 16, a pair of arm assemblies 22 for supporting opposite ends of the roller assembly 20, and lower and upper mounting brackets 24, 26 for securing the arm assemblies 22 to the recreational vehicle side wall 14.

The canopy 16 is a sheet of flexible material such as, for example, fabric, canvas, or nylon and is preferably rectangularly shaped. The inner edge of the canopy 16 is secured to the awning rail 18 and the outer edge of the canopy 16 is secured to the roller assembly 20. The inner edge of the canopy 16 is preferably provided with an awning rope 28. The awning rope 28 is preferably a polypropylene rope and is mounted in a hem or pocket formed at the inner edge of the canopy 16.

As best shown in FIGS. 4 and 7, the awning rail 18 horizontally extends along the side wall 14 of the recreational vehicle 12 at an elevated position and is rigidly secured thereto by suitable fasteners at the support structure of the side wall. The awning rail 18 is preferably an extrusion and more preferably an aluminum extrusion. The awning rail 18 has a length slightly longer than the width of the canopy 16 and preferably about the width between the outer sides of the arm assemblies 22 (best shown in FIG. 3). The awning rail 18 is typically provided as part of the recreational vehicle 12 by the manufacturer of the recreational vehicle 12.

The extruded awning rail 18 preferably has a cross-sectional shape including a main wall 30 with top and bottom legs rearwardly or inwardly extending from the top and bottom edges to engage and space the main wall 30 away from the recreational vehicle side wall 14. Forwardly and downwardly extending from the bottom edge of the main wall 30 is an awning rope retainer 32. The awning rope retainer 32 is generally C-shaped in cross-section forming a longitudinally extending channel. In cross-section, the channel has a longitudinally extending, circular-shaped opening and a longitudinally extending slot 34 at a forward or outward side of the opening. A longitudinally extending guide flange or rain gutter 36 outwardly extends from the awning rope retainer. The gutter 36 vertically extends from the upper edge of the slot 34 and is generally parallel to the main wall 30. Such a configuration is ideal when the awning rail 18 is to be attached to a substantially vertical portion of the recreational vehicle side wall 14. The awning rope 28 is contained in the awning rope retainer 32 with the canopy 16 extending through the slot 34 to secure the inner edge of the canopy 16 to the awning rail 18.

As best shown in FIG. 3, the roller assembly 20 preferably includes a roller tube 38, a pair of end caps 40 closing the open ends of the roller tube 38, axles or bars 42 which rotatably support the roller tube 38, and a torsion spring 44. Each end cap 40 is rigidly secured to the roller tube 38 for rotation therewith and has a central opening. The bar 42 extends through the central opening such that the roller tube 38 and the end cap 40 are free to rotate together with respect to the bar 42. The torsion spring 44 is disposed around the bar 42 within the roller tube 38. The spring 44 is operably connected between the roller tube 38 and the bar 42 in any known manner so that rotation of the roller tube 38 with respect to the bar 42 varies tension of the spring 44. The torsion spring 44, therefore, can be preloaded for biasing the roller tube 38 to roll-up the canopy 16 onto the roller tube 38.

Each arm assembly 22 is disposed in a generally vertical plane at an associated side edge of the canopy 16 and an associated end of the roller assembly 20. Each arm assembly 22 preferably includes a support arm 46 and a rafter arm 48. The support arm 46 has an upper end connected to the end of the roller assembly 20 and a lower end pivotally connected to the lower mounting bracket 24. The rafter arm 48 has an outer end operably connected to the support arm 46 and an inner end pivotally connected to the upper mounting bracket 26. When in the extended position, the rafter arm 48 opposes the spring bias of the roller assembly 20 to prevent the support arm 46 from pivoting inwardly about the lower mounting bracket toward the retracted position. The support arm 46 and the rafter 48 arm are each preferably formed from a lightweight, high strength material such as, for example, an aluminum alloy.

Each support arm 46 includes telescoping outer and inner members 50, 52 to vary the length of the support arm 46. The outer member 50, which is preferably disposed at the upper end of the support arm 46, has a sliding relationship with the inner member 52.

As best shown in FIGS. 5 and 6, the outer member 50 of the support arm 46 is preferably U-shaped in cross-section and forms a channel which extends along the entire length of the outer member 50. The inner member 52 of the support arm 46 is sized and shaped for sliding within the channel of the outer member 50 to vary the length of the support arm 46. The inner member 52 is also preferably U-shaped in cross section and forms a channel which extends along the entire length of the inner member 52.

As best shown in FIG. 3, the support arm 46 also includes means 54 for locking the outer member 50 and the inner member 52 together in a desired relationship to maintain the support arm 46 at a desired length. The locking means 54 can be of any suitable type such as, for example, the illustrated button assembly.

As best shown in FIGS. 3 and 4, the top end of the support arm 46 is rigidly secured to and supports the roller assembly 20. The top of the support arm outer member 50 is provided with an end cap 56. The end cap is preferably a zinc casting and is rigidly secured to the support arm outer member 50 by suitable fasteners. The bar 42 of the roller assembly 20 extends into the end cap 56 and is rigidly secured thereto. The bar 42 is preferably maintained in a fixed relationship with the end cap 56 by a pin 58 or other suitable means.

The bottom end of the support arm 46 is pivotally connected to the lower mounting bracket 24. The lower mounting bracket 24 is secured to the side wall 14 of the recreational vehicle 12 beneath the awning rail 18 at a relatively low position. The bottom of the support arm inner member 52 is provided with an end cap or foot member 59. The foot member 59 is rigidly secured to the support arm inner member 52 by a suitable fastener 60 such as, the illustrated rivet. The foot member 59 can be pivotally attached to the lower bracket 24 by a removable fastener 61, such as the illustrated safety pin, or can be auto latching wherein no safety pin is used.

As best shown in FIG. 5, each rafter arm 48 preferably includes telescoping outer and inner members 62, 64 to vary the length of the rafter arm 48. The outer member 62, which is preferably disposed at the inner end of the rafter arm 48, has a sliding relationship with the inner member 64. The outer and inner members 62, 64 of the rafter arm 48 are each preferably rectangularly-shaped in cross-section. The inner member 64 of the rafter arm 48, however, is sized for sliding within the outer member 62 to vary the length of the rafter arm 48.

As best shown in FIGS. 4 and 5, the rafter arm 48 also includes means 66 for locking the outer member 62 and the inner member 64 together in a desired relationship to maintain the rafter arm 48 at a desired length. The locking means 66 can be of any suitable type such as, for example, the illustrated screw knob assembly.

As best shown in FIGS. 4 and 6, the rafter arm inner member 64 is pivotally mounted to a slide 68 by a pin or tube rivet 70 to secure the outer end of the rafter arm 48 to the support arm 46. The slide 68 carries the outer end of the rafter arm 48 along the support arm 46 and secures it thereto. The slide 68 is generally U-shaped in cross-section with a pair of outwardly extending flanges 72. These flanges 72 are longitudinally slidable within an associated pair of channels formed within the outer member 50 of the support arm 46. A screw 74 or other suitable blocking means is preferably disposed in the channel near the lower end of the support arm outer member 50 to ensure that the slide 68 does not separate from the support arm 46.

As best shown in FIGS. 4 and 7, the support arm 46 preferably includes means 76 for locking the outer end of the rafter arm 48 relative to the upper end of the support arm 46 when in the extended position. The locking means 76 can be of any suitable type such as, for example, the illustrated spring assembly.

As best shown in FIGS. 4 and 7, the rafter arm outer member 62 is pivotally attached to the upper mounting bracket 26 to secure the inner end of the rafter arm 48 to the recreational vehicle side wall 14. The upper mounting bracket 26 includes a mounting portion 78 for mounting the upper mounting bracket 26 to the recreational vehicle side wall 14 and an attachment portion 80 for pivotally attaching the rafter arm 48 to the upper mounting bracket 26. The mounting portion 78 and attachment portion 80 are preferably integral with one another, that is, formed by one piece.

The mounting portion 78 of the upper mounting bracket 26 is sized and shaped to cooperate with the awning rail 18 so that the bracket 26 cradles and is disposed over the awning rail 18. There is preferably no portion of the upper mounting bracket 26 which directly contacts and/or bears against the recreational vehicle side wall 14. The mounting portion 78 includes a longitudinally extending cavity sized and shaped to receive the awning rope retainer 32 and the gutter 36 of the awning rail 18 therein. The attachment portion 78 also includes a vertically extending flange sized and shaped to engage the outer surface of the main wall 30 of the awning rail 18. The mounting portion 78 is secured to the recreational side surface by mechanical fasteners 82 such as, for example, bolts which extend through openings in both the flange and the awning rail main wall 30. Preferably, the openings in the rail main wall 30 are added during installation of the awning using openings in the mounting portion 78 as a template.

Mounted in this manner, the upper mounting bracket 26 is positively located with respect to the awing rail 18, and thus the recreational vehicle structure, and transfers at least a portion of the mounting and application forces of the awning assembly 10, which are transmitted through the rafter arm 48, to the awning rail 18. Therefore, such forces are not transferred to the skin of the side wall 14 so that damage to the skin of the side wall 14 is prevented.

The attachment portion 80 of the upper mounting bracket 26 is sized and shaped for receiving a pin or tube rivet 84 secured to the rafter arm 48 to pivotally attach the rafter arm 48 thereto. The attachment portion 80 preferably has an opening which is C-shaped in cross-section for receiving the rivet 84. The attachment portion 80 is located downwardly and outwardly from the awning rail 18 as shown in FIGS. 4 and 7.

As best shown in FIG. 1, the support arms 46 and the rafter arms 48 have a substantially parallel relationship with the side wall 14 of the recreational vehicle 12 when the awning assembly 10 is in the stored position. To move the awning assembly 10 to the extended position, the locking means 66 of the rafter arms 48 is loosened so that the rafter arms 48 are free to expand. Next, the operator unlocks the roll tube locks. The operator then outwardly pulls the roll tube 38 which outwardly pivots the support arms 46 about the lower mounting brackets 24. The awning unrolls from the roller tube 38 as the support arms 46 outwardly move. With this movement of the support arms 46, the rafter arms 48 are removed from the channels of the support arms 46. The slides 68 are manually moved upwardly, moving the outer ends of the rafter arms 48 along the support arms 46 and as the inner ends of the rafter arms 48 upwardly pivot on the upper mounting bracket 26. When the slides 68 reach the top of the support arms 48, the rafter arms 46 are extended and the locking means 76 automatically locks the outer ends of the rafter arms 46 to the top of the support arms 48.

The length of the rafter arms 48 and the support arms 46 are adjusted to vary the length and the height respectively of the canopy 16. Once their lengths have been adjusted, the rafter arms 48 and the support arms 46 are locked by operation of their respective locking means 66, 54. If desired, the lower ends of the support arms 48 can be removed from the lower brackets 24 and placed on the ground. The above-described steps for moving the awning assembly 10 from the retracted position to the extended position are reversed to move the awning assembly 10 from the extended position to the retracted position.

Figure 8:
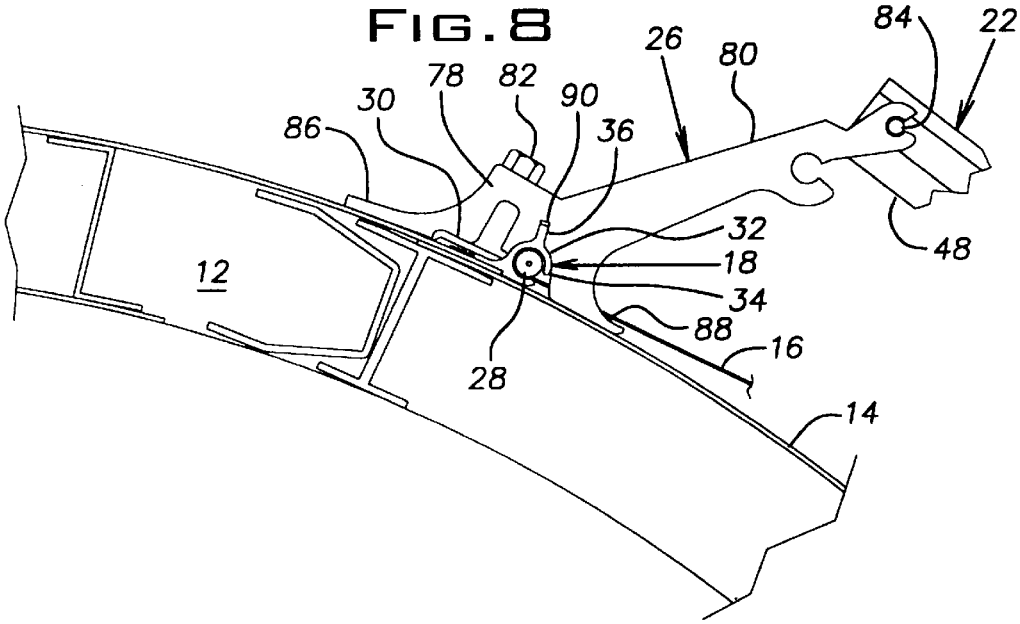
FIG. 8 is a fragmented side elevational view similar to FIG. 7 but showing a second embodiment of the present invention.

FIG. 8 illustrates a second embodiment of the awning assembly 10 according to the present invention wherein like reference numbers are used for like structure. In the illustrated second embodiment, the awning assembly 10 is mounted to an upper curved portion of the recreational vehicle side wall 14. The second embodiment is similar to the above described first embodiment except that the awning rail 18 and upper mounting brackets 26 each have a different configuration as described in more detail hereinafter.

The awning rope retainer 32 of the awning rail 18 is again generally C-shaped in cross-section forming a longitudinally extending channel. In cross-section, however, the longitudinally extending slot 34 of the channel is at a lower or outward side of the opening and is generally adjacent the main wall 30. Additionally, the gutter 36 outwardly extends from the awning rope retainer 32 and is spaced about 90 degrees from the upper edge of the slot 34. In this position, the gutter 36 is generally perpendicular to the main wall 30. Such a configuration is ideal when the awning rail 18 is to be attached to an upper curved portion of the recreational vehicle side wall 14.

The upper mounting bracket 26 again includes a mounting portion 78 which is sized and shaped to cooperate with the awning rail 18 so that the bracket 26 cradles and is disposed over the awning rail 18. The mounting portion 78, however, also includes upper and lower flanges 86, 88 which engage the recreational vehicle side wall 14 above and below the awning rail 18, immediately adjacent the awning rail 18. It is noted that while the bracket 26 contacts the wall 14, it is sized and shaped to bear loads through the awning rail 18. The upper and lower flanges 86, 88 have wall engagement surfaces which are sized and shaped to cooperate with the contour of the recreational vehicle side wall 14 at the awning rail 18. In the illustrated embodiment, the engagement surfaces are arcuate curved.

The longitudinally extending cavity of the mounting portion 78 is again sized and shaped to receive the awning rope retainer 32 and the gutter 36 of the awning rail 18 therein. The cavity, however, further includes a longitudinally extending slot sized and shaped for closely receiving the gutter 36. The upper mounting bracket 26, therefore, engages both sides of the gutter 36 and positively positions the upper mounting bracket 26 with respect to the awning rail 18. The upper mounting bracket 26 is again attached by one of the threaded fasteners 82 attaching the awning rail 18 to the recreational vehicle side wall 14.

Mounted in this manner, the upper mounting bracket 26 is positively located with respect to the awning rail 18, and thus the recreational vehicle structure, and transfers at least a portion of the mounting and application forces of the awning assembly 10, which are transmitted through the rafter arm 48, to the awning rail 18. Therefore, such forces are not transferred to the skin of the side wall 14 so that damage to the skin of the side wall 14 is prevented.

Although particular embodiments of the invention have been described in detail, it will be understood that the invention is not limited correspondingly in scope, but includes all changes and modifications coming within the spirit and terms of the claims appended hereto.

What is claimed is:

1. A retractable awning assembly for mounting to a wall; said awning assembly comprising:

a rail for attachment to the wall, said rail having a longitudinally extending channel and a main wall having an inner surface for engaging the wall and an opposing outer surface;

a roller;

a flexible canopy having an inner edge for connection to said channel and an outer edge secured to said roller;

a pair of upper mounting brackets for attachment at opposite ends of said rail, each of said upper mounting brackets being sized and shaped to cradle said rail around said channel and having a mounting portion sized and shaped for engaging said outer surface of said main wall; and a pair of arm assemblies supporting opposite ends of said roller and operable to move said roller between a retracted position adjacent the wall and an extended position spaced from the wall, each of said arm assemblies having a support arm and a rafter arm, said support arm having an upper end operably connected to said roller and a lower end securable to the wall, said rafter arm having an outer end operably connected to said support arm and an inner end for attachment to said upper mounting bracket.

2. The awning assembly according to claim 1, wherein each of said upper mounting brackets has a longitudinally extending cavity sized and shaped for receiving a portion of said channel therein.

3. The awning assembly according to claim 2, wherein said channel is C-shaped in cross-section.

4. The awning assembly according to claim 2, wherein said rail has a gutter outwardly extending from said channel, and said cavity is sized and shaped to receive said gutter therein.

5. The awning assembly according to claim 1, wherein said upper mounting brackets have fasteners extending through said main wall of said rail and said mounting portion of said upper mounting brackets.

6. The awning assembly according to claim 1, wherein said rail has a length which extends at least a distance between said rafter arms.

7. A recreational vehicle comprising:

a wall;

a rail attached to said wall, said rail having a longitudinally extending channel and a main wall having an inner surface engaging said wall and an opposing outer surface; and a retractable awning including:

a roller;

a flexible canopy having an inner edge connected to said channel and an outer edge secured to said roller;

a pair of upper mounting brackets attached at opposite ends of said rail, each of said upper mounting brackets disposed over said rail and covering said channel and having a mounting portion engaging said outer surface of said main wall; and a pair of arm assemblies supporting opposite ends of said roller and operable to move said roller between a retracted position adjacent said wall and an extended position spaced from said wall, each of said arm assemblies having a support arm and a rafter arm, said support arm having an upper end operably connected to said roller and a lower end connected to said wall, said rafter arm having an outer end operably connected to said support arm and an inner end attached to said upper mounting bracket.

8. The recreational vehicle according to claim 7, wherein each of said upper mounting brackets has a longitudinally extending cavity with a portion of said channel therein.

9. The recreational vehicle according to claim 8, wherein said channel is C-shaped in cross-section.

10. The recreational vehicle according to claim 7, wherein said rail has a gutter above said channel, and said cavity has a portion of said gutter therein.

11. The recreational vehicle according to claim 7, wherein said upper mounting brackets have fasteners which extend through both said rail and said upper mounting brackets.

12. The recreational vehicle according to claim 7, wherein said rail extends at least between said rafter arms.

13. An retractable awning assembly for mounting to a wall, said awning assembly comprising:

a rail for attachment to the wall said rail having a longitudinally extending channel which is generally C-shaped in cross-section and a longitudinally extending gutter outwardly extending from said channel;

a roller;

a flexible canopy having an inner edge for connection to said channel and an outer edge secured to said roller;

a pair of upper mounting brackets for attachment at opposite ends of said rail, each of said upper mounting brackets being sized and shaped to cradle said rail over said channel and having a longitudinally extending slot for closely receiving a portion of said gutter therein; and a pair of arm assemblies supporting opposite ends of said roller and operable to move said roller between a retracted position adjacent the wall and an extended position spaced from the wall, each of said arm assemblies having a support arm and a rafter arm, said support arm having an upper end operably connected to said roller and a lower end securable to the wall, said rafter arm having an outer end operably connected to said support arm and an inner end for attachment to said upper mounting bracket.

14. The awning assembly according to claim 13, wherein each of said upper mounting brackets has a longitudinally extending cavity sized and shaped for receiving a portion of said channel therein.

15. The awning assembly according to claim 13, wherein said rail has a main wall for engaging the wall and each of said upper brackets has a mounting portion sized and shaped for engaging said main wall of said rail.

16. The awning assembly according to claim 15, wherein said upper mounting bracket has fasteners which extend through said main wall of said rail and said mounting portion of said upper mounting brackets.

17. The awning assembly according to claim 13, wherein said rail has a length which extends at least between said rafter arms.

18. A recreational vehicle comprising:

a wall;

a rail attached to said wall, said rail having a longitudinally extending channel which is generally C-shaped in cross-section and a longitudinally extending gutter outwardly extending from said channel; and a retractable awning including:

a roller;

a flexible canopy having an inner edge connected to said channel and an outer edge secured to said roller;

a pair of upper mounting brackets attached at opposite ends of said rail, each of said upper mounting brackets disposed over said rail and having a longitudinally extending slot for closely receiving a portion of said gutter therein; and a pair of arm assemblies supporting opposite ends of said roller and operable to move said roller between a retracted position adjacent said wall and an extended position spaced from said wall, each of said arm assemblies having a support arm and a rafter arm, said support arm having an upper end operably connected to said roller and a lower end connected to said wall, said rafter arm having an outer end operably connected to said support arm and an inner end attached to said upper mounting bracket.

19. The recreational vehicle according to claim 18, wherein each of said upper mounting brackets has a longitudinally extending cavity with a portion of said channel therein.

20. The recreational vehicle according to claim 18, wherein said rail has a main wall engaging said wall and each of said upper brackets has a mounting portion engaging said main wall of said rail.

21. The recreational vehicle according to claim 20, wherein said upper mounting brackets have fasteners extending through said main wall of said rail and said mounting portion of said upper mounting brackets.

22. The recreational vehicle according to claim 18, wherein said rail extends at least between said rafter arms.

23. The awning assembly according to claim 1, wherein said upper mounting brackets do not directly contact the wall when said upper mounting brackets are attached at opposite ends of said rail.

24. The recreational vehicle according to claim 7, wherein said upper mounting brackets do not directly contact said wall.

* * * * *